US010023988B2

(12) United States Patent
Yu et al.

(10) Patent No.: US 10,023,988 B2
(45) Date of Patent: Jul. 17, 2018

(54) WASHING MACHINE

(71) Applicant: LG Electronics Inc., Seoul (KR)

(72) Inventors: Insik Yu, Seoul (KR); Youngjun Kim, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1160 days.

(21) Appl. No.: 14/014,747

(22) Filed: Aug. 30, 2013

(65) Prior Publication Data

US 2014/0060120 A1 Mar. 6, 2014

(30) Foreign Application Priority Data

Aug. 31, 2012 (KR) ..... 10-2012-0096551

(51) Int. Cl.
*D06F 37/24* (2006.01)

(52) U.S. Cl.
CPC ..... *D06F 37/24* (2013.01)

(58) Field of Classification Search
CPC ..... D06F 37/24; F16F 7/09
See application file for complete search history.

(56) References Cited

U.S. PATENT DOCUMENTS

| | | | | |
|---|---|---|---|---|
| 2,318,806 | A * | 5/1943 | Sisson et al. | D06F 37/22 210/364 |
| 6,122,942 | A * | 9/2000 | Jung | D06F 37/24 68/23.3 |
| 2004/0226321 | A1 | 11/2004 | Park et al. | |

FOREIGN PATENT DOCUMENTS

| | | | |
|---|---|---|---|
| JP | 07-008677 | | 1/1995 |
| JP | 2004290704 | A * | 10/2004 |
| KR | 20-1991-0003155 | | 5/1991 |
| KR | 20-1991-0003156 | U | 5/1991 |
| KR | 100195454 | B1 * | 6/1999 |
| KR | 200159084 | Y1 * | 10/1999 |
| KR | 10-2003-0034952 | | 5/2003 |
| KR | 200320745 | Y1 * | 7/2003 |
| KR | 10-2004-0092758 | | 11/2004 |
| KR | 10-2007-0046451 | | 5/2007 |

OTHER PUBLICATIONS

JP 2004290704—Machine Translation, Oct. 2004.*
KR 200320745—Machine Translation, Jul. 2003.*
KR 200159084—Machine Translation, Oct. 1999.*
KR 100195454—Machine Translation, Jun. 1999.*
KR 20040092758—Machine Translation, Nov. 2004.*
KR20070046451—Machine Translation (Year: 2007).*
KR20030034952—Machine Translation (Year: 2003).*
KR19910003156—Machine Translation (Year: 1991).*

* cited by examiner

*Primary Examiner* — Marc Lorenzi
(74) *Attorney, Agent, or Firm* — Dentons US LLP

(57) ABSTRACT

Disclosed is a washing machine including a casing, an outer tub located within the casing, at least one support member to suspend the outer tub from the casing, a suspension, provided at a lower side of the outer tub and connected to the at least one support member, to attenuate vibration of the outer tub and at least one horizontal vibration attenuation unit to attenuate horizontal vibration of the outer tub by the introduction of friction according to a horizontal displacement of the outer tub.

8 Claims, 16 Drawing Sheets

WASHING MACHINE

CROSS-REFERENCE TO RELATED APPLICATION

This application claims the priority benefit of Korean Patent Application No. 10-2012-0096551, filed on Aug. 31, 2012, in the Korean Intellectual Property Office, the disclosure of which is incorporated herein by reference in its entirety.

BACKGROUND OF THE INVENTION

1. Field of the Invention

The present invention relates to a washing machine.

2. Description of the Related Art

In general, a washing machine is an appliance that washes laundry using surfactant action of detergent, a water stream generated via rotation of a washing tub or a washing blade, shock applied by the washing blade, and the like. The washing machine performs washing, rinsing and/or dehydration processes to remove contaminants adhered to laundry (hereinafter referred to as 'clothes') using interaction of water and detergent.

A typical washing machine includes a casing defining an external appearance of the washing machine, an outer tub accommodated in a suspended manner within the casing, and an inner tub rotatably placed within the outer tub. The washing machine further includes a suspension to attenuate vibration when the outer tub vibrates due to rotation of the inner tub and/or a pulsator.

The suspension, typically, is configured to attenuate vibration generated from the outer tub using elasticity/restoration force of a spring, viscosity of a fluid, and the like. However, the suspension may effectively attenuate vibration in a normal state in which the outer tub vibrates with a constant vibration amplitude range, but has difficulty in appropriately dealing with vibration, the amplitude of which is greater than that in the normal vibration state.

In the configuration of the related art, in particular, four corners of the casing are connected respectively to support members, and each support member is connected to the outer tub via the suspension. This configuration is basically intended to deal with vibration of the outer tub in a vertical direction. In the above described related art, as the suspension mounted at four locations attenuates vertical vibration of the outer tub, even horizontal vibration of the outer tub is also attenuated to some extent. However, this is merely a subordinate effect caused by attenuation of vibration in the vertical direction of the outer tub. When horizontal vibration becomes severe, for example, when eccentricity is caused within the inner tub, it is necessary to cease operation of the washing machine.

SUMMARY OF THE INVENTION

Effects of the present invention will be clearly understood by those skilled in the art from the disclosure of the accompanying claims.

In accordance with an aspect of the present invention, there is provided a washing machine including a casing, an outer tub located within the casing, at least one support member to suspend the outer tub from the casing, a suspension, provided at a lower side of the outer tub and connected to the at least one support member, to attenuate vibration of the outer tub and at least one horizontal vibration attenuation unit to attenuate horizontal vibration of the outer tub by the introduction of friction according to a horizontal displacement of the outer tub.

BRIEF DESCRIPTION OF THE DRAWINGS

Embodiments will be described in detail with reference to the following drawings in which like reference numerals refer to like elements, and wherein.

DETAILED DESCRIPTION OF THE PREFERRED EMBODIMENTS

The advantages and features of the present invention and the way of attaining them will become apparent with reference to embodiments described below in detail in conjunction with the accompanying drawings. Embodiments, however, may be embodied in many different forms and should not be constructed as being limited to example embodiments set forth herein. Rather, these example embodiments are provided so that this disclosure will be through and complete and will fully convey the scope to those skilled in the art. The scope of the present invention should be defined by the claims. Wherever possible, the same reference numbers will be used throughout the drawings to refer to the same or like parts.

Figure 1:
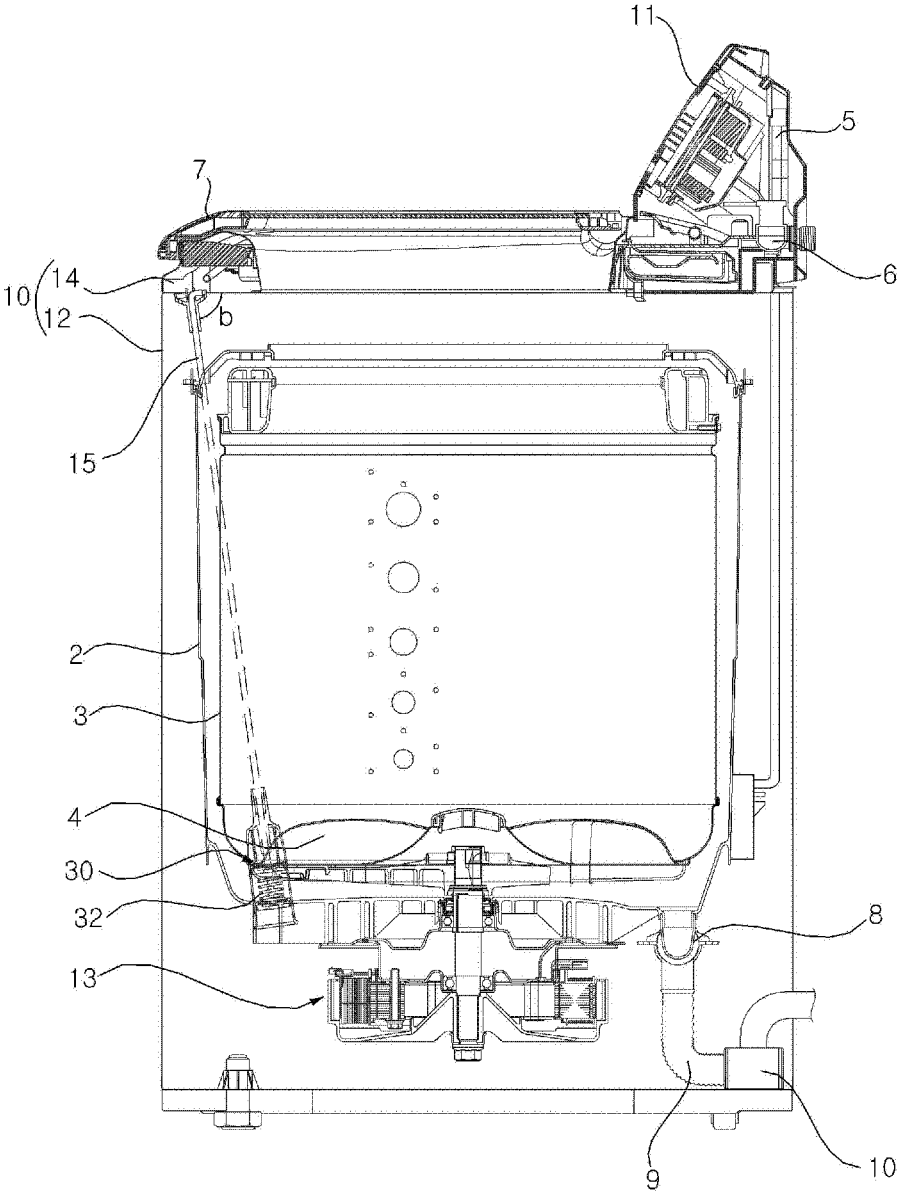
FIG. 1 is a view showing the interior of a washing machine according to an embodiment of the present invention.

FIG. 1 is a view showing the interior of a washing machine according to an embodiment of the present invention. Referring to FIG. 1, the washing machine according to the embodiment of the present invention includes a casing 10 that defines an external appearance of the washing machine, a control panel 11 that provides a user interface equipped with manipulation keys to allow a user to input a variety of control instructions, a display panel to display information related to an operation mode of the washing machine, and the like, and a door 7 rotatably coupled to the casing 10 to close and open an opening (not shown) for introduction and removal of laundry.

An outer tub 2, in which wash water is accommodated, is installed in a suspended manner within the casing 10 via a support member 15. In turn, an inner tub 3, in which laundry is accommodated, is rotatably placed within the outer tub 2. A pulsator 4 is rotatably mounted to the bottom of the inner tub 3. The inner tub 3 has a plurality of holes for passage of wash water.

Although the casing 10 as defined in the present invention simply serves to define an external appearance of the washing machine, in particular, it is desirable that the casing 10 be a rigid body installed with a fixed position, to allow one end of the support member 15 that suspends the outer tub 2 to be secured to the casing 10.

The casing 10 may include a main body 12, the top of which is open, and a top cover 14 coupled to an upper side of the main body 12, the opening for introduction and removal of laundry being perforated approximately in the center of the top cover 14.

The casing 10 may be provided with a support part 16 by which one end of the support member 15 is rotatably supported. The support part 16 may be formed at any one of the main body 12 or the top cover 14 so long as the support part 16 is positioned at a fixed position within the casing 10.

One end of the support member 15 is rotatably secured to the casing 10. Although the support member 15 may be directly coupled to the casing 10, hereinafter, the support member 15 will be described as being secured to the casing 10 with the support part 16 interposed therebetween.

The support member 15, one end of which is connected to the support part 16, is connected at the other end thereof to the outer tub 2 via a suspension 30. The suspension 30 serves not only to connect the support member 15 and the outer tub 2 to each other, but also to attenuate vibration of the outer tub 2 generated during operation of the washing machine.

The suspension 30 may include an elastic member that is elastically deformed in response to vibration of the outer tub 2. As the elastic member, for example, a spring 32 is deformed in response to vibration of the outer tub 2, the vibration is alleviated. According to embodiments, the suspension 30 may be a damper or vibration absorber that absorbs vibration of the outer tub 2, or may simultaneously perform shock absorbing and damping functions.

Further explaining reference numerals and corresponding components exemplarily shown in FIG. 1, a water supply passageway 5 is connected to an external water source, such as, for example, a water tap, to supply water into the outer tub 2 and/or the inner tub 3. A water supply valve 6 turns the water supply passageway 5 on and off. A drive unit 13 serves to drive the inner tub 3 and/or the pulsator 4. A water discharge passageway 9 is installed to discharge wash water from the outer tub 2. A water discharge valve 8 turns the water discharge passageway 9 on and off. A water discharge pump 10 serves to pump wash water discharged through the water discharge passageway 9 to the outside of the washing machine.

Figure 2:
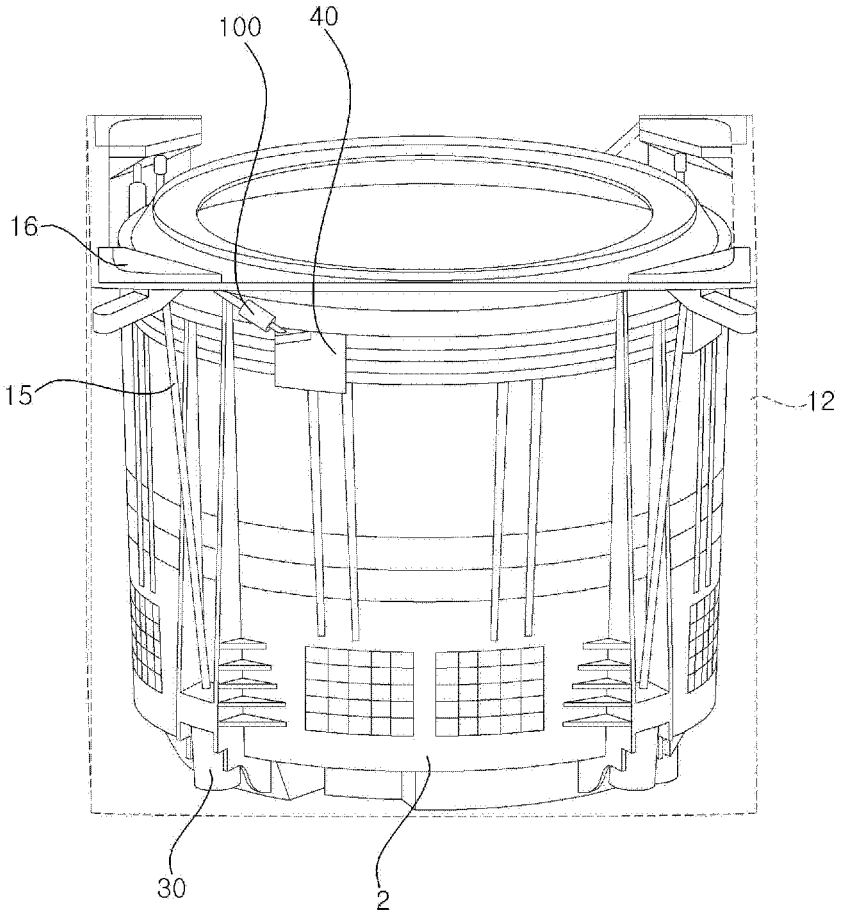
FIG. 2 is a view showing a coupling configuration of a horizontal vibration attenuation unit according to a first embodiment of the present invention.
Figure 3:
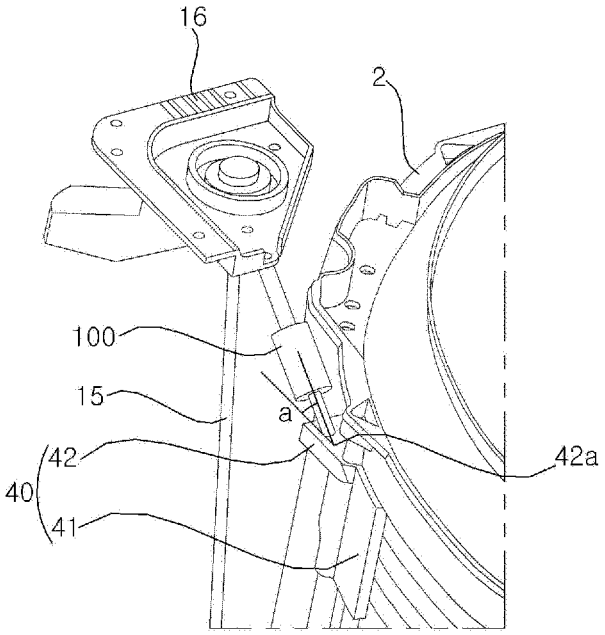
FIG. 3 is a view showing a coupling relationship of the horizontal vibration attenuation unit shown in FIG. 2.
Figure 4:
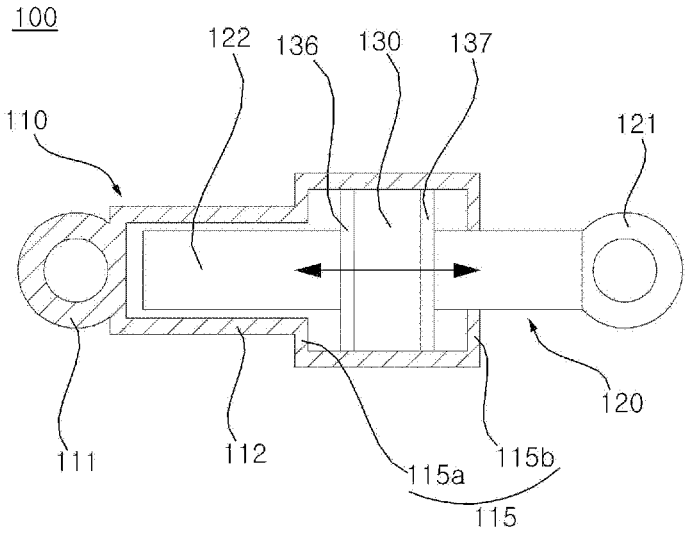
FIG. 4 is a sectional view showing a configuration of the horizontal vibration attenuation unit shown in FIG. 3.

FIG. 2 is a view showing a coupling configuration of a horizontal vibration attenuation unit 100 according to a first embodiment of the present invention. FIG. 3 is a view showing a coupling relationship of the horizontal vibration attenuation unit 100 shown in FIG. 2. FIG. 4 is a sectional view showing a configuration of the horizontal vibration attenuation unit 100 shown in FIG. 3.

Referring to FIGS. 2 to 4, the washing machine according to the embodiment of the present invention includes the horizontal vibration attenuation unit 100 that provides frictional force corresponding to displacement of an upper side of the outer tub 2 to perform a damping function.

The horizontal vibration attenuation unit 100 serves to attenuate vibration of the outer tub 2 when the outer tub 2 vibrates due to rotation of the inner tub 3. In particular, the horizontal vibration attenuation unit 100 includes a friction member 130 that is moved according to displacement of the upper side of the outer tub 2. In this way, when the outer tub 2 vibrates, vertical vibration is mostly attenuated by the suspension 30 provided at a lower side of the outer tub 2, and horizontal vibration is mostly attenuated by the horizontal vibration attenuation unit 100 provided at the upper side of the outer tub 2.

The horizontal vibration attenuation unit 100 may include a first connection member 110 connected to the casing 10, and a second connection member 120, one end of which is connected to the upper side of the outer tub 2 and the other end of which is connected to the first connection member 110. The second connection member 120 is movable relative to the first connection member 110 in response to vibration of the outer tub 2.

The first connection member 110 may include a casing connection portion 111 connected to the casing 10, and a cylinder 112 into which a piston 122 of the second connection member 120 that will be described hereinafter is inserted. The casing connection portion 111 may be rotatably connected to the casing 10, more particularly to the support part 16 via a fastening member, such as a screw, bolt, pin, or the like.

The second connection member 120 may include the piston 122 that is moved along the cylinder 112 in response to vibration of the outer tub 2, and an outer tub connection portion 121 that is formed at an end of the piston 122 and connected to the outer tub 2. An outer circumferential surface of the piston 122 and an inner circumferential surface of the cylinder 112 may come into surface contact with each other. In this case, when the piston 122 slides along the cylinder 112, a predetermined magnitude of frictional force may be generated between the piston 122 and the cylinder 112.

The outer tub connection portion 121 may be rotatably coupled to a connection member coupling part 40 formed at the upper side of the outer tub 2. Even if sagging of the outer tub 2 occurs according to load, damage to the horizontal vibration attenuation unit 100 is prevented via pivoting of the casing connection portion 111 and/or the outer tub connection portion 121.

The connection member coupling part 40 is provided at the outer tub 2 and connected to the second connection member 120. The connection member coupling part 40 may include a curved base 41 configured to conform to the shape of a lateral surface of the outer tub 2, and a coupling protrusion 42 extending from the base 41 such that the outer tub connection portion 121 is rotatably coupled to the coupling protrusion 42.

The connection member coupling part 40 may be integrally injection molded with the outer tub 2. Alternatively, the connection member coupling part 40 may be prefabricated separately from the outer tub 2 and then be coupled or fused to the outer tub 2.

In particular, the second connection member 120 may be arranged such that the casing connection portion 111 is positioned higher than the outer tub connection portion 121. In this case, as exemplarily shown in FIG. 3, the second connection member 120 is connected to the coupling protrusion 42 while having a predetermined angle a with respect to a substantially horizontal coupling surface 42*a*. The angle a is an angle between a horizontal plane and a longitudinal axis of the horizontal vibration attenuation unit 100, and is less than an angle (b, see FIG. 1) between the support member 15 and the horizontal plane.

The friction member 130 is adapted to be movable along the second connection member 120. The first connection member 110 includes a friction member receptacle 115 that provides an accommodation space for the friction member 130. The friction member 130 is placed in the friction member receptacle 115 while being coupled to the piston 122 so as to surround the piston 122. With this configuration, movement of the friction member 130 is limited such that the friction member 130 is moved in the friction member receptacle 115. More particularly, movement of the friction member 130 is limited to a space between a first restrictor 115*a* and a second restrictor 115*b* which are set to correspond to a length of the friction member receptacle 115.

The friction member 130 may be accommodated in the friction member receptacle 115 in a slightly compressed state. The friction member 130 may be formed of a fibrous material, such as felt, and the like, or may be formed of a slightly elastic material, such as rubber, synthetic resins, and the like.

The friction member 130 may include shock absorbing members 136 and 137 to prevent generation of noise when the friction member 130 collides with the friction member receptacle 115. In the present embodiment, the shock absorbing members 136 and 137 are provided respectively at both sides of the friction member 130, but the disclosure is not limited thereto. In addition, the shock absorbing members 136 and 137 may be provided between the friction member 130 and the friction member receptacle 115 in the embodiments that will be described hereinafter.

In particular, an inner circumferential surface of the friction member 130 undergoes friction with an outer circumferential surface of the piston 122 and an outer circumferential surface of the friction member 130 undergoes friction with an inner circumferential surface of the friction member receptacle 115. In this case, it is desirable that friction caused between the inner circumferential surface of the friction member 130 and the outer circumferential surface of the piston 122 be greater than friction caused between the outer circumferential surface of the friction member 130 and the inner circumferential surface of the friction member receptacle 115.

A degree of vibration of the outer tub 2, generated when the inner tub 3 is rotated to implement, for example, dehydration, may vary according to various factors, such as arrangement eccentricity of clothes within the inner tub 3, the quantity of clothes, the quantity of water, rotation speed, and the like. In this case, in a predetermined time period for which vibration of the outer tub 2 is less generated, generation of vibration does not cause serious problems so long as a movement distance of the second connection member 120 relative to the first connection member 110 is within a reference displacement that allows vibration of the outer tub 2. For example, assuming that the reference displacement is defined by a predetermined value that does not cause collision between the outer tub 2 and the main body 12, free movement of the second connection member 120 is allowed to some extent within the reference displacement. Within the reference displacement, it is desirable that the friction member 130 be moved along with the piston 122 rather than being moved behind the piston 122, to allow relatively free movement of the second connection member 120. To this end, in the present embodiment, an extremely small magnitude of frictional force is generated between the outer circumferential surface of the friction member 130 and the inner circumferential surface of the friction member receptacle 115. Alternatively, according to embodiments, a damping function due to frictional force between the piston 122 and the cylinder 112 is accomplished even within the reference displacement.

If vibration of the outer tub 2 greatly increases such that displacement of the second connection member 120 exceeds the reference displacement, an additional damping force acquired by frictional force between the friction member 130 and the second connection member 120 is required. If displacement of the second connection member 120 is within the reference displacement, movement of the second connection member 120 (i.e. movement relative to the first connection member 110) is implemented within a range in which the friction member 130 is only slightly moved or the friction member 130 is secured to the second connection member 120. To achieve a predetermined magnitude of frictional force between the friction member 130 and the piston 122 when position shift beyond the reference displacement occurs, a longitudinal length of the friction member receptacle 115, frictional force between the friction member 130 and the friction member receptacle 115, and frictional force between the friction member 130 and the piston 122 must be determined in consideration of the reference displacement. Here, the frictional force is kinetic frictional force caused by movement of the friction member 130 relative to the first connection member 110 or the second connection member 120. High frictional force must be provided between the friction member 130 and the second connection member 120 (more particularly, frictional force between the friction member 130 and the piston 122). It is desirable that frictional force between the friction member 130 and the second connection member 120 be greater than frictional force between the friction member 130 and the first connection member 110, more particularly, the friction member receptacle 115.

If displacement of the second connection member 120 exceeds the reference displacement, the friction member 130 is moved in frictional contact along the second connection member 120, thus achieving greater damping performance than that given within the reference displacement.

If displacement of the second connection member 120 is within the reference displacement, this may refer to a state in which rotation of the inner tub 3 enters a normal state (for example, a state in which the inner tub 3 is rotated at a high speed with clothes evenly distributed therein during dehydration). If displacement of the second connection member 120 exceeds the reference displacement, this may refer to a transient state before rotation of the inner tub 3 enters a normal state, or the case in which the inner tub 3 is rotated in a state in which clothes is unevenly distributed in the inner tub 3 thus causing eccentricity.

Figure 5:
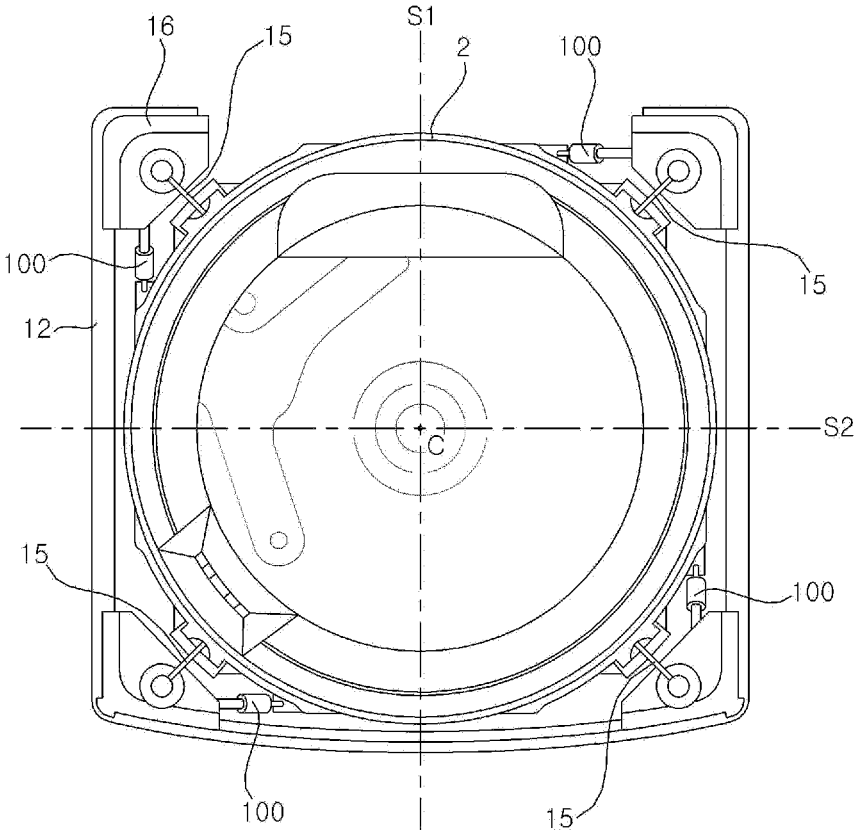
FIG. 5 is a view showing an arrangement relationship of the horizontal vibration attenuation unit according to the first embodiment.

FIG. 5 is a view showing an arrangement relationship of the horizontal vibration attenuation unit 100 according to the first embodiment. Referring to FIG. 5, the horizontal vibration attenuation unit 100 may be arranged at each of four corners of the casing 10. Specifically, four support members 15 may be provided at respective corners of the casing 10, and a plurality of horizontal vibration attenuation units 100 may be provided equal in number to the number of the support members 15. The respective horizontal vibration attenuation units 100 may be connected to the outer tub 2 at the same side on the basis of a corresponding one of the support members 15.

More specifically, the support part 16 is formed at each corner of the casing 10, and the support member 15 is connected to the support part 16. In this case, the horizontal vibration attenuation unit 100 is rotatably coupled at one end thereof to the support part 16 and rotatably coupled at the other end thereof to the outer tub 2. As exemplarily shown in FIG. 5, the respective horizontal vibration attenuation units 100 are arranged at the same side on the basis of the respective support members 15. The horizontal vibration attenuation units 100 provided at corners facing each other have a point symmetry relationship on the basis of the center of the outer tub 2, thus achieving high stability in terms of structure. Moreover, even if vibration of the outer tub 2, in particular, horizontal vibration occurs in a given direction, the horizontal vibration attenuation units 100 may achieve a sufficient damping function to cope with the horizontal vibration.

Referring to FIG. 5, in a configuration in which the first connection member 110 is connected to each of four corners of the outer tub 2, assuming that two symmetry axes passing the center c of the outer tub 2 are S1 and S2, the second connection member 120 is connected to the outer tub 2 at a position where the second connection member 120 does not pass over a corresponding one of the symmetry axes S1 and S2.

A distance between the outer tub 2 and the main body 12 becomes the minimum on the axis S1 or S2. Thus, in the case in which the second connection member 120 is connected to the outer tub 2 on the axis S1 or S2, or any one component of the horizontal vibration attenuation unit 100 is arranged on the same axis, a distance between the outer tub 2 and the main body 12 is reduced due to a space occupied by the component. However, in consideration of vibration of the outer tub 2, it is necessary to maintain a certain distance between the outer tub 2 and the main body 12. Therefore, given the above described configuration, this substantially results in a reduced capacity of the outer tub 2 on the basis of the same volume of the main body 12. Accordingly, in the present embodiment, the horizontal vibration attenuation unit 100, which is located at any one side of the symmetry axis, has a connection portion with respect to the outer tub 2, which is located within a range not passing over the symmetry axis.

Figure 6A:
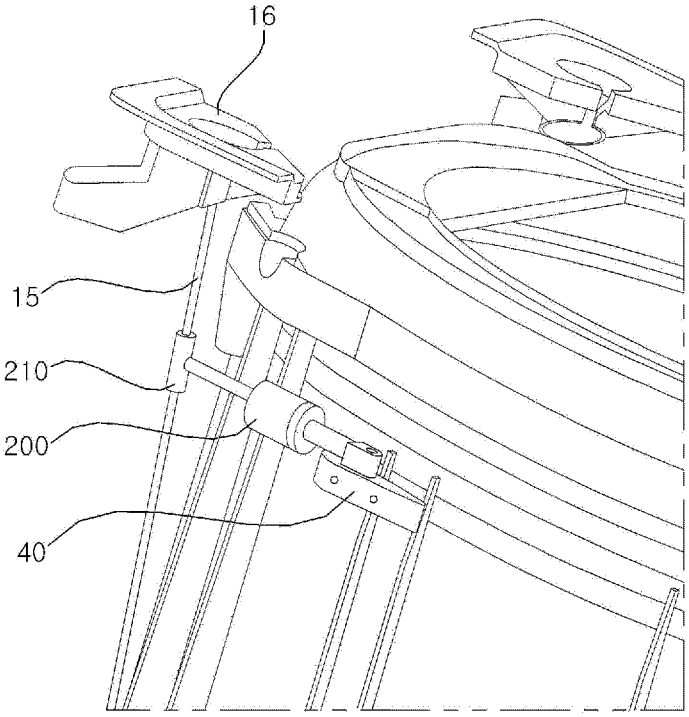
FIG. 6A is a view showing a coupling relationship of a horizontal vibration attenuation unit according to a second embodiment of the present invention.
Figure 6B:
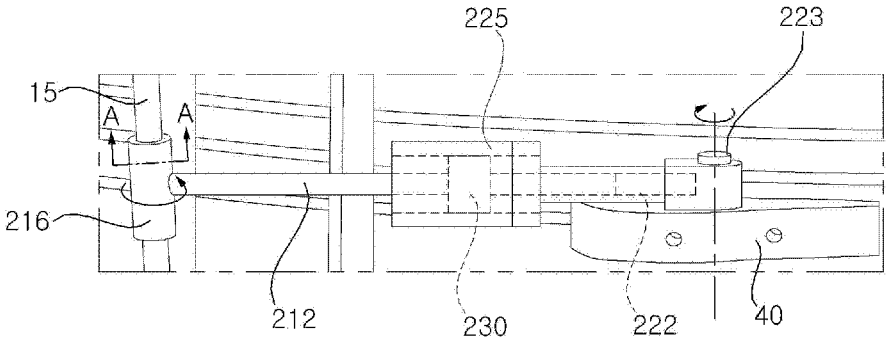
FIG. 6B is a partial enlarged view of FIG. 6A.
Figure 7:
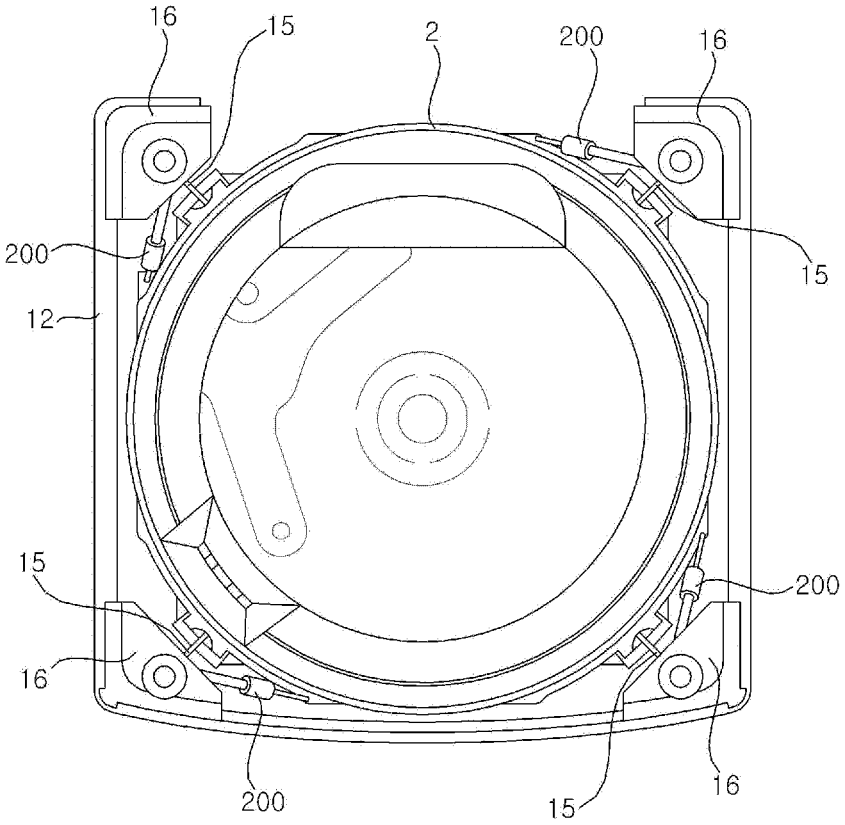
FIG. 7 is a view showing an arrangement relationship of the horizontal vibration attenuation unit according to the second embodiment.

FIG. 6A is a view showing a coupling relationship of a horizontal vibration attenuation unit 200 according to a second embodiment of the present invention. FIG. 6B is a partial enlarged view of FIG. 6A. FIG. 7 is a view showing an arrangement relationship of the horizontal vibration attenuation unit 200 according to the second embodiment.

Referring to FIGS. 6A and 6B, the horizontal vibration attenuation unit 200 according to the second embodiment of the present invention includes a first connection member 210, which differs from the first connection member 110 of the first embodiment in that the first connection member 210 is movable along the support member 15.

The first connection member 210 includes a movable connector 216 that is displaceable along the support member 15, and a piston 212 extending from the movable connector 216. The movable connector 216 has a through-bore 217 into which the support member 15 is inserted.

A second connection member 220 is adapted to be moved relative to the first connection member 210 in response to vibration of the outer tub 2. The second connection member 220 may include an outer tub connection portion 221 connected to the outer tub 2, a cylinder 222 into which the piston 212 is inserted, and a friction member receptacle 225 in which a friction member 230 is accommodated.

The second connection member 220 is provided at one end thereof with the outer tub connection portion 221, which is rotatably connected to the coupling part 40 of the outer tub 2. The outer tub connection portion 221 is fastened to the connection member coupling part 40 via a fastening member 223, such as a screw, bolt, pin, or the like.

In the horizontal vibration attenuation unit 200 according to the present embodiment, the first connection member 210 is vertically movable along the support member 15. Accordingly, the first connection member 210 is vertically moved in response to load which varies according to the quantity of water accommodated in the outer tub 2 or the quantity of clothes introduced into the inner tub 3, thereby providing a constant damping force even if the load is changed.

That is, even if load is changed, relative positions between the piston 212 and the cylinder 222 may be maintained owing to vertical movement of the first connection member 210. This ensures relative movement of the first connection member 210 and the second connection member 220 within a predictable range that meets a design criterion, which provides an advantage in terms of maintenance of a damping force and vibration control.

According to embodiments, in the same manner as the first embodiment, the second connection member 220 may include a piston, the first connection member 210 may include a cylinder into which the piston is inserted, and the friction member 230 may be movable along the piston.

Referring to FIG. 7, the horizontal vibration attenuation unit 200 according to the present embodiment may be arranged at each of the four corners of the casing 10 in the same manner as the above described first embodiment, and effects of this arrangement are equal to the above description of the first embodiment.

Figure 8:
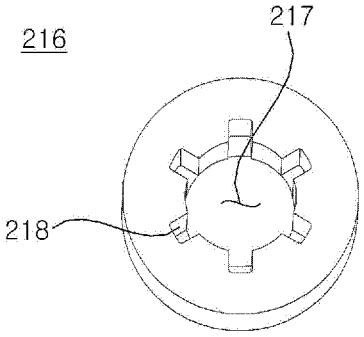
FIG. 8 is a sectional view showing one embodiment of an elevation bar shown in FIG. 7.

FIG. 8 is a sectional view taken along the line A-A of FIG. 6B. Referring to FIG. 8, the movable connector 216 may have a through-bore 217 through which the support member 15 penetrates, and recesses 218 may be indented around the through-bore 217 for application of grease to an interface between the support member 15 and the movable connector 216 around the through-bore 217.

The recesses 218 are cut in a radial outward direction from the through-bore 217. The bottom of the recesses 218 may be occluded to prevent the applied grease from flowing downward, but the top of the recesses 218 may be open or occluded. In particular, in the case of the recesses 218 having the open top, application of grease for the purpose of maintenance and repair may be easily implemented even after the horizontal vibration attenuation unit 200 is completely installed.

Owing to the grease applied in the recesses 218, the first connection member 210 may be smoothly vertically moved along the support member 15 in response to load of the outer tub 2. In addition, even in the case of high speed rotation of the inner tub 3, abnormal noise generation due to movement of the first connection member 210 may be reduced, and abrasion of the first connection member 210 due to sliding on the support member 15 may be prevented.

Figure 9:
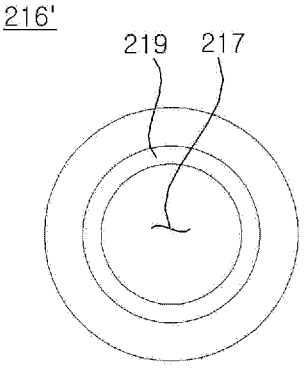
FIG. 9 is a sectional view showing another embodiment of the elevation bar shown in FIG. 7.

FIG. 9 is a sectional view showing a movable connector 216' according to another embodiment. Referring to FIG. 9, the movable connector 216' internally defines the through-bore 217 through which the support member 15 penetrates, and an elastic member 219 may be provided between the through-bore 217 and the support member 15. The elastic member 219 may be formed of any material that is slightly deformed upon receiving external force and is then restored to an original shape thereof upon removal of external force. For example, the elastic member 219 may be formed of natural or synthetic rubber.

Even when the inner tub 3 is rotated at a high speed, accordingly, abnormal noise generation due to movement of the first connection member 210 may be reduced, and abrasion of the first connection member 210 due to sliding on the support member 15 may be prevented.

Figure 10:
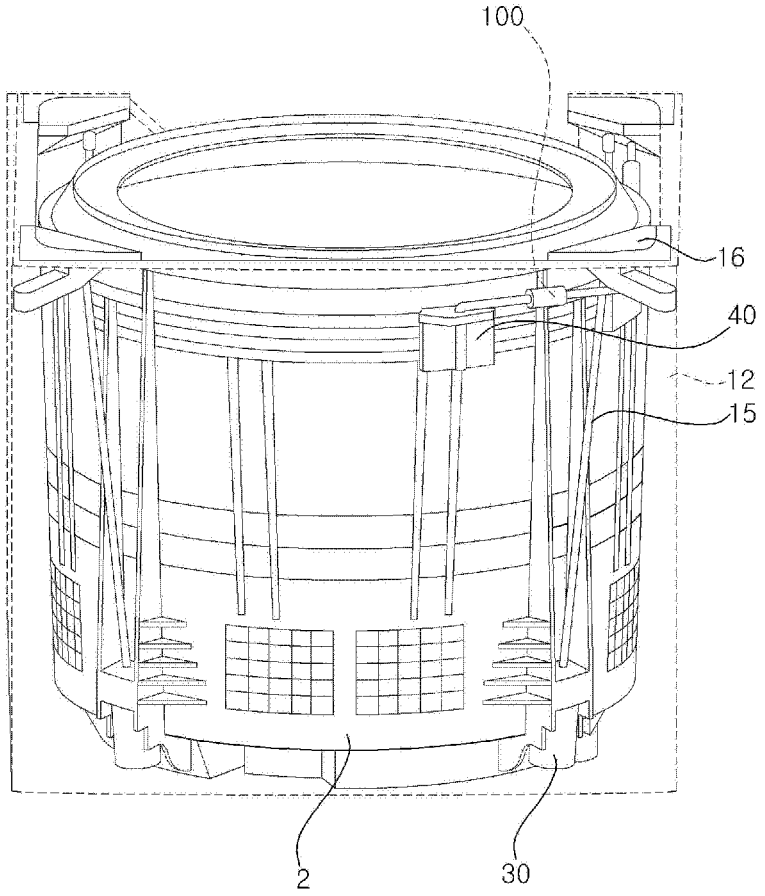
FIG. 10 is a view showing a horizontal vibration attenuation unit and a washing machine having the same according to a third embodiment of the present invention.
Figure 11:
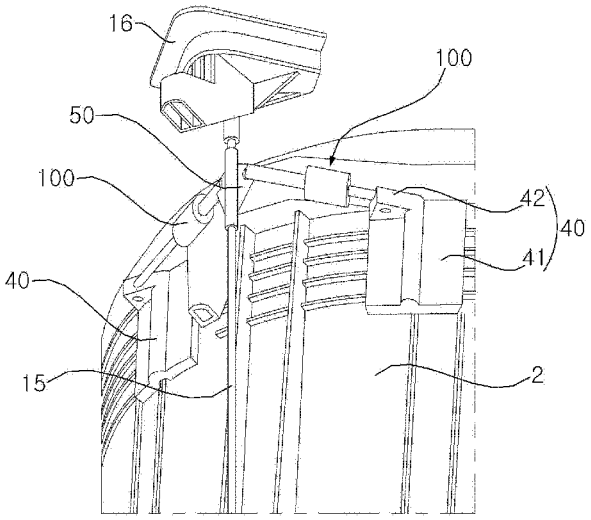
FIG. 11 is a partial enlarged view of FIG. 10.
Figure 12:
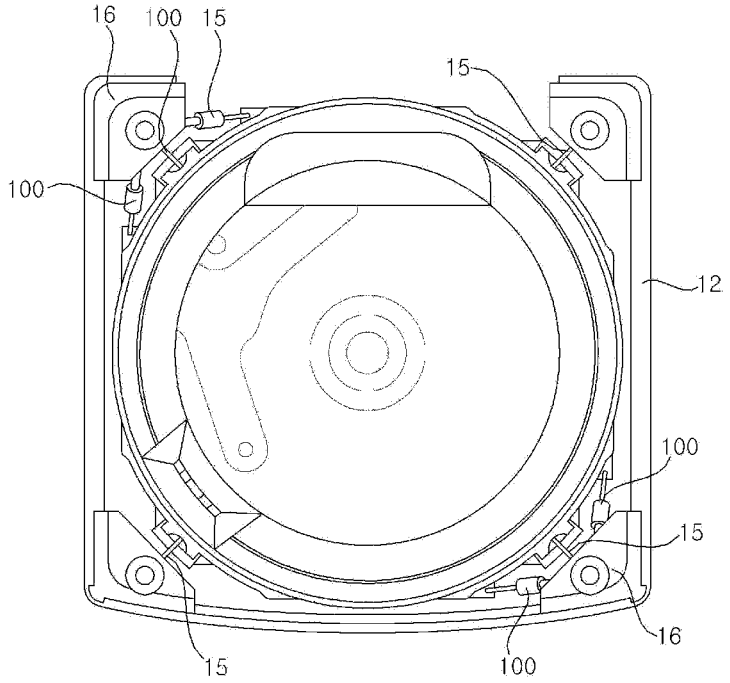
FIG. 12 is a view showing an arrangement relationship of the horizontal vibration attenuation unit of FIG. 10 when viewed from the top.

FIG. 10 is a view showing a horizontal vibration attenuation unit and a washing machine having the same according to a third embodiment of the present invention. FIG. 11 is a partial enlarged view of FIG. 10. FIG. 12 is a view showing an arrangement relationship of the horizontal vibration attenuation unit of FIG. 10 when viewed from the top.

Referring to FIGS. 10 to 12, the washing machine according to the third embodiment of the present invention includes a slider 50 that is connected to the support member 15 so as to slide along the support member 15. A pair of horizontal vibration attenuation units 100 is symmetrically arranged at both sides of the slider 50.

In the following description, a configuration of the horizontal vibration attenuation unit 100 is basically equal to that of the horizontal vibration attenuation unit 100 according to the first embodiment, except that the first connection member 110 is connected to the slider 50 in place of the casing 10. However, according to embodiments, the horizontal vibration attenuation unit 100 according to the present embodiment may be equal to the horizontal vibration attenuation unit 200 according to the second embodiment. These horizontal vibration attenuation units 100 and 200 have concomitant features in that the first connection member 110; 210 is movable relative to the second connection member 120; 220 according to vibration of the outer tub 2 and in that a damping force caused by kinetic frictional force between the friction member 130; 230 and the piston 122; 212 is acquired according to a degree of vibration.

The outer tub 2 is provided with the connection member coupling parts 40 at both sides of the support member 15, and the horizontal vibration attenuation units 100 are connected to the respective connection member coupling parts 40. A coupling configuration between the connection member coupling part 40 and the horizontal vibration attenuation unit 100 is substantially equal to the coupling configuration according to the first embodiment or the second embodiment, and thus a description of the coupling configuration will be omitted hereinafter.

In the washing machine according to the present embodiment, as exemplarily shown in FIG. 12, the horizontal vibration attenuation units 100 are provided only at a pair of corners of the casing 10 facing each other, in place of being provided at all four corners of the casing 10. Of course, although the horizontal vibration attenuation units 100 may be provided at the other corners, since the pair of horizontal vibration attenuation units 100 is provided at both sides of the slider 50, symmetric arrangement may be accomplished even when the horizontal vibration attenuation units 100 are installed only at the pair of corners facing each other. Thereby, the horizontal vibration attenuation units 100 may effectively cope with horizontal vibration of the outer tub 2.

Figure 13:
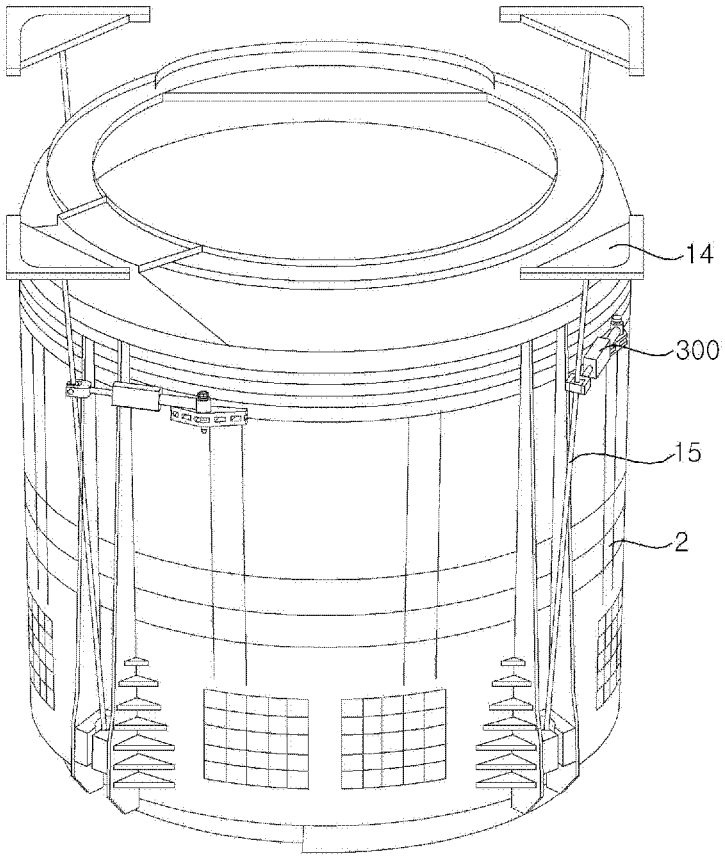
FIG. 13 is a view showing a horizontal vibration attenuation unit and a washing machine having the same according to a fourth embodiment of the present invention.
Figure 14:
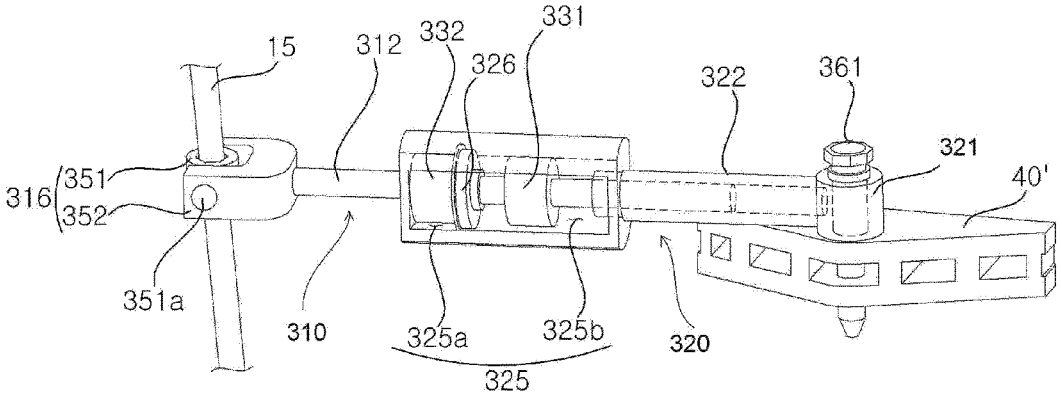
FIG. 14 is a partial enlarged view of FIG. 13.
Figure 15:
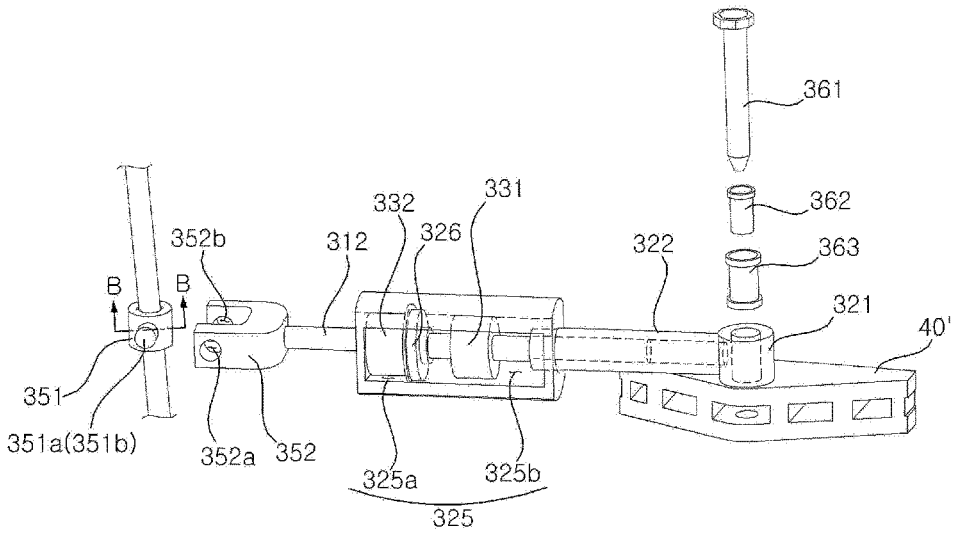
FIG. 15 is an exploded perspective view of components shown in FIG. 14.

FIG. 13 is a view showing a horizontal vibration attenuation unit 300 and a washing machine having the same according to a fourth embodiment of the present invention. FIG. 14 is a partial enlarged view of FIG. 13. FIG. 15 is an exploded perspective view of components shown in FIG. 14.

Referring to FIGS. 13 to 15, the horizontal vibration attenuation unit 300 according to the fourth embodiment of the present invention basically includes a first connection member 310 that is movable along the support member 15, and a second connection member 320 that is moved relative to the first connection member 310 according to vibration of the outer tub 2. Although this basic configuration is similar to that of the horizontal vibration attenuation unit 200 according to the second embodiment, the present embodiment has an important difference in that a movable connector 316 is movable along the support member 15 in addition to being rotatable.

The movable connector 316 includes a slider 351 that is slidable along the support member 15, and a rotational joint 352 rotatably connected to the slider 351. Any one of the slider 351 and the rotational joint 352 may be provided with coupling pins 351*a* and 351*b*, and the other one may be provided with coupling holes 352*a* and 351*b* for insertion and coupling of the coupling pins 351*a* and 351*b*.

In the present embodiment, a piston 312 extends from the rotational joint 352 and a friction member 330 is movable along the piston 312. However, differently from the second embodiment, two friction members 331 and 332 are provided.

Similar to the second connection member 220 according to the second embodiment, the second connection member 320 includes a cylinder 322 into which the piston 312 is inserted, and a friction member receptacle 352 in which the friction members 331 and 332 are accommodated. However, the present embodiment has a difference in that the friction member receptacle 325 is divided into a first receptacle 325*b* and a second receptacle 325*a* by a partition 326 such that the two friction members 331 and 332 are separately accommodated.

The second friction member 332 is accommodated in compressed to a predetermined degree. Thus, the second friction member 332 may be moved along with the second connection member 320 in response to vibration of the outer tub 2, thereby generating a predetermined magnitude of frictional force with the piston 312.

The friction member receptacle 325 may have an opening having a predetermined area to allow passage of the friction member 330 for the purpose of assembly. The second connection member 320 may be integrally formed via injection molding, for example. In this case, assembly may be completed by inserting the friction member 330 into the friction member receptacle 325 through the opening, and thereafter coupling the first connection member 310 and the second connection member 320 to each other. In this way, the present embodiment provides an advantage in that the second connection member 320 may be fabricated as a single member that is easy to assemble.

An outer tub connection portion 321 of the second connection member 320 is rotatably connected to the connection member coupling part 40 via a pin 361. In this case, in place of directly coupling the pin 361 to the outer tub connection portion 321, a bushing 362 and an elastic member 363 may be interposed between the pin 361 and the outer tub connection portion 321. In this case, assembly is completed as the elastic member 363 is inserted into the outer tub connection portion 321, the bushing 362 is inserted into the elastic member 363, and the pin 361 is inserted into the bushing 362. This configuration may induce smooth operation of the second connection member 320, reduce abnormal noise generation, and improve assembly performance.

Although the present embodiment describes that the second connection member 310, into which the first connection member 310 is inserted, is moved relative to the first connection member 310 according to vibration of the outer tub 2, the disclosure is not limited thereto. According to embodiments, the first connection member connected to the casing 10 may be configured to surround the second connection member (see FIG. 4) so as to be moved relative to the second connection member according to vibration of the outer tub 2.

Figure 16:
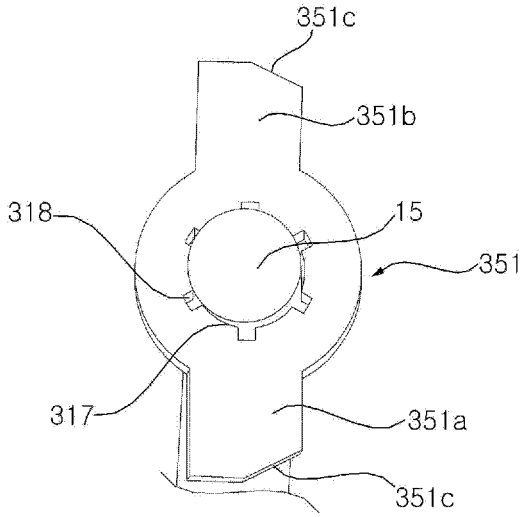
FIG. 16 is a sectional view taken along the line B-B of FIG. 15.

FIG. 16 is a sectional view taken along the line B-B of FIG. 15. Referring to FIG. 16, the coupling pins 351*a* and 351*b* to be inserted respectively into the coupling holes 352*a* and 352*b* may be formed at both sides of the slider 351, and each of the coupling pins 351*a* and 351*b* may have a slope 351*c* at an end thereof to assist the coupling pins 351*a* or 351*b* in being smoothly inserted into the coupling hole 352*a* or 352*b*.

The slider 351 may have a central through-bore 317 through which the support member 15 penetrates, and recesses 318 may be indented around the through-bore 317 for application of grease to an interface between the support member 15 and the slider 351 around the through-bore 317.

Figure 17:
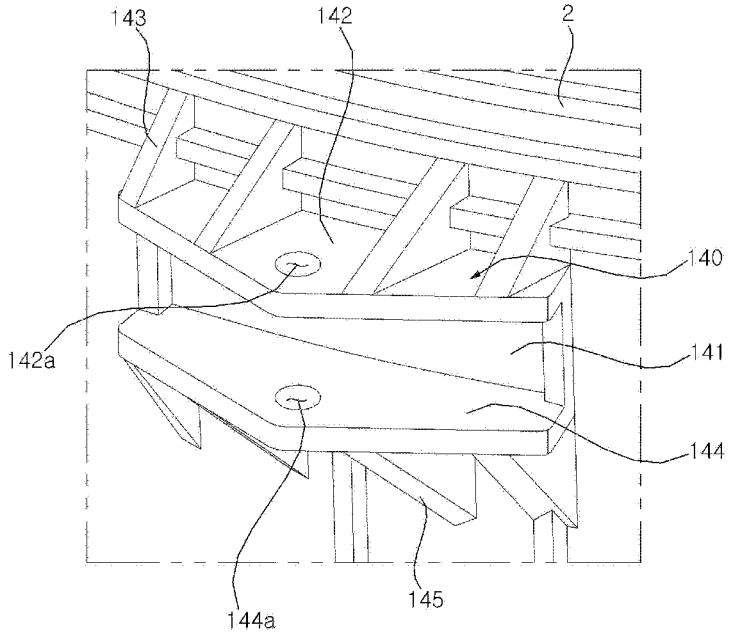
FIG. 17 is a view showing a connection member coupling part according to another embodiment of the present invention.

FIG. 17 is a view showing a connection member coupling part 140 according to another embodiment of the present invention. Referring to FIG. 17, the connection member coupling part 140 that will be described hereinafter serves to connect the horizontal vibration attenuation unit 300 as described above with reference to FIGS. 13 to 16 to the outer tub 2.

The connection member coupling part 140 includes a base 141 parallel to a lateral surface of the outer tub 2, and a pair of coupling ridges 142 and 144 protruding from the base 141 such that the outer tub connection portion 321 is rotatably coupled to the coupling ridges 142 and 144. The first coupling ridge 142 and the second coupling ridge 144 are arranged parallel to each other, and the outer tub connection portion 321 is located between the coupling ridges 142 and 144.

The coupling ridges 142 and 144 have coupling apertures 142*a* and 144*a* respectively. The bushing 362, the elastic member 363, and the pin 361 are inserted into and coupled to the coupling apertures 142*a* and 144*a* (see FIG. 15). A plurality of reinforcement ribs 143 and 145 is formed to increase rigidity of the coupling ridges 142 and 144. The reinforcement ribs 143 and 145 may include a plurality of first reinforcement ribs 143, which extend upward approximately perpendicular to the first coupling ridge 142 so as to connect the first coupling ridge 142 and the outer tub 2 to each other, and a plurality of second reinforcement ribs 145, which extend downward approximately perpendicular to the second coupling ridge 144 so as to connect the second coupling ridge 144 and the outer tub 2 to each other. The coupling ridges 142 and 144 may exhibit sufficient rigidity corresponding to vibration of the outer tub 2, which prevents damage or deformation of the coupling ridges 142 and 144.

The connection member coupling part 140 may be integrally formed with the outer tub 2, or may be provided as a separate member so as to be integrally coupled with the outer tub 2 via thermal fusion, or using a fastening member, such as a screw, bolt, or the like.

Figure 18:
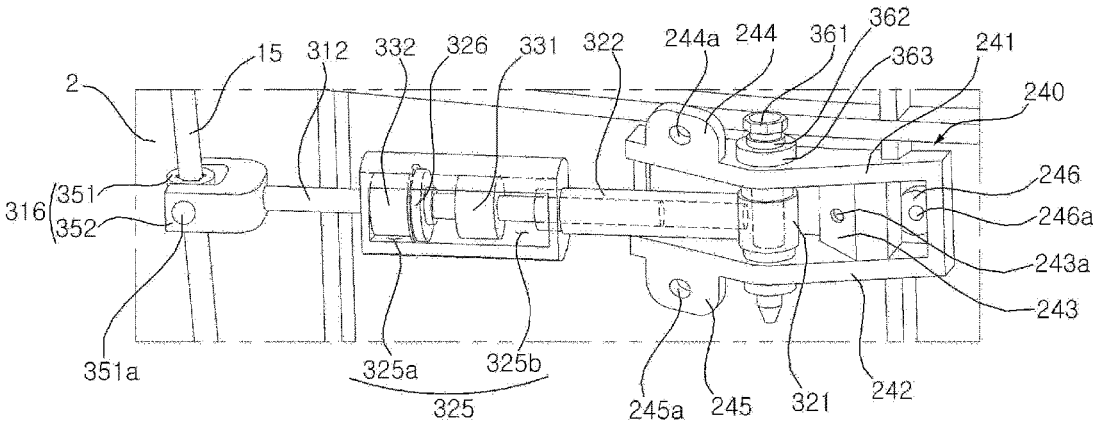
FIG. 18 is a view showing a connection member coupling part according to a further embodiment of the present invention.
Figure 19:
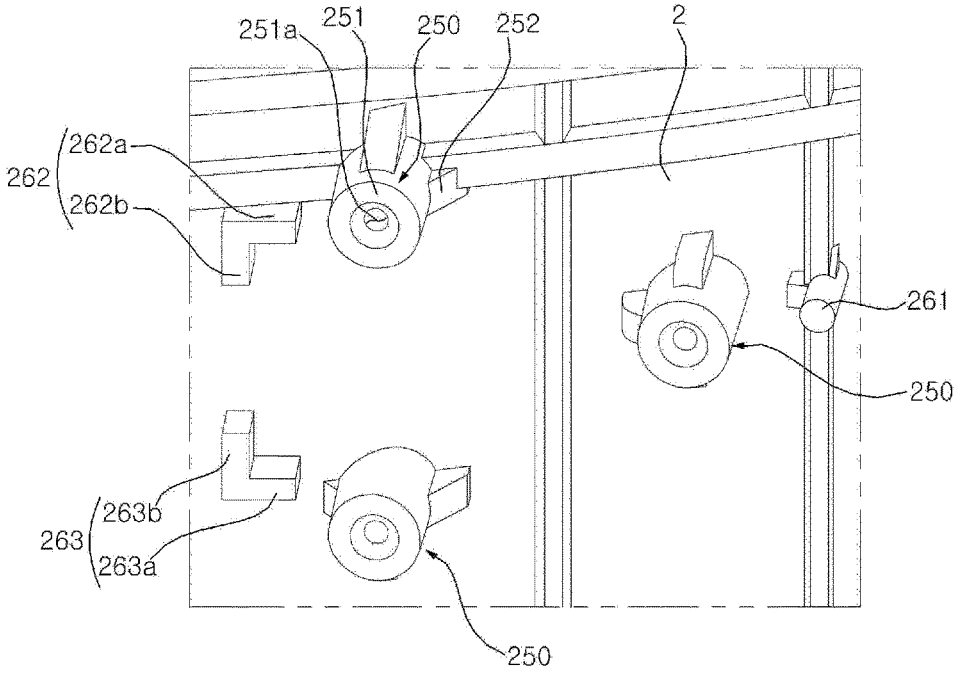
FIG. 19 is a partial enlarged view of FIG. 18.

FIG. 18 is a view showing a connection member coupling part according to a further embodiment of the present invention. FIG. 19 is a partial enlarged view of FIG. 18.

FIG. 18 illustrates the horizontal vibration attenuation unit 300 as described above with reference to FIGS. 13 to 16. Components designated by the same reference numerals have the same configuration as those of the above description, and a description of these components will be omitted hereinafter.

The connection member coupling part 240 includes a pair of coupling arms 241 and 242, which protrude approximately perpendicular to the lateral surface of the outer tub 2 such that the outer tub connection portion 321 is rotatably coupled to the coupling arms 241 and 242. The first coupling arm 241 and the second coupling arm 242 are arranged parallel to each other, and the outer tub connection portion 321 is located between the coupling arms 241 and 242.

The coupling arms 241 and 242 respectively have coupling apertures such that the bushing 362, the elastic member 363, and the pin 361 are inserted into and coupled to the coupling apertures. In addition, the connection member coupling part 240 is supported by support pieces 250 that will be described hereinafter. The connection member coupling part 240 further includes one or more support plates 243, 244 and 245 provided respectively with fastening holes 243*a*, 244*a* and 245*a* for insertion and coupling of screws, bolts, pins, or the like.

The support plates 243, 244 and 245 may include a first support plate 244, which extends upward from the first coupling arm 241, i.e. in a direction opposite to the second coupling arm 242, a second support plate 245, which extends downward from the second coupling arm 242, i.e. in a direction opposite to the first coupling arm 241, and a third support plate 243 which extends between the first coupling arm 241 and the second coupling arm 242 to connect the first coupling arm 241 and the second coupling arm 242 to each other. In addition, the connection member coupling part 240 may further include a fourth support plate 246 having an insertion hole 246*a* for insertion of a guide rod 261 that will be described hereinafter.

The outer tub 2 may be provided with at least one support piece 250 to secure the connection member coupling part 240. The support piece 250 may be integrally formed with the outer tub 2, or may be provided as a separate member to thereby be integrally coupled with the outer tub 2.

The support piece 250 may include a coupling boss 251, which extends approximately perpendicular to the lateral surface of the outer tub 2 and has a fastening hole 251*a* for insertion and coupling of a fastening member, and a reinforcement rib 252 extending between an outer circumferential surface of the coupling boss 251 and the outer tub 2.

In addition, the outer tub 2 may be provided with one or more anti-movement ribs 262 and 263 to restrict movement of the connection member coupling part 240. More specifically, the first anti-movement rib 262 includes a horizontal extension 262*a*, which extends in an approximately horizontal direction to restrict upward movement of the connection member coupling part 240, and a vertical extension 262*b* which extends downward perpendicular to the horizontal extension 262*a*. The second anti-movement rib 263 includes a horizontal extension 263*a*, which extends in an approximately horizontal direction to restrict downward movement of the connection member coupling part 240, and a vertical extension 263*b* which extends upward perpendicular to the horizontal extension 263*a*.

The guide rod 261 serves to guide approximate positioning of the connection member coupling part 240 upon coupling thereof such that the fastening holes 243*a*, 244*a* and 245*a* are positioned to correspond respectively to the fastening holes 251*a* of the support pieces 250. When regulating the approximate position of the connection member coupling part 240 such that the connection member coupling part 240 is located between the first anti-movement rib 262 and the second anti-movement rib 263 in a state in which the guide rod 261 is inserted into the insertion hole 246*a*, the respective fastening holes 243*a*, 244*a* and 245*a* of the connection member coupling part 240 are positioned respectively to correspond to the fastening holes 251*a* of the support pieces 250. In such a state, the connection member coupling part 240 may be coupled to the support pieces 250 using fastening members.

Figure 20:
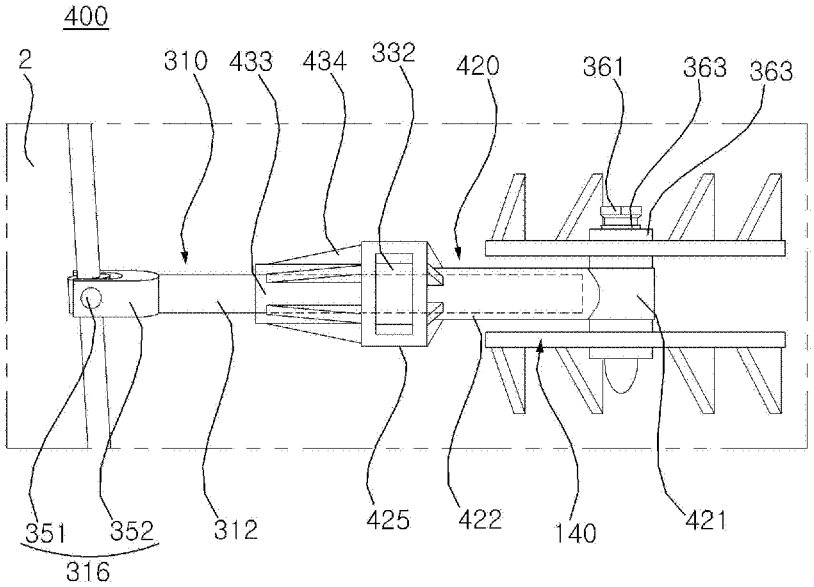
FIG. 20 is a view showing a horizontal vibration attenuation unit according to a fifth embodiment of the present invention.

FIG. 20 is a view showing a horizontal vibration attenuation unit 400 according to a fifth embodiment of the present invention. Referring to FIG. 20, hereinafter, components designated by the same reference numerals have the same configuration as those of the above description and a detailed description of these components will thus be omitted. Thus, the following description shall focus upon such differences.

The horizontal vibration attenuation unit 400 includes the first connection member 310 that is movable along the support member 15, and a second connection member 420 that is moved relative to the first connection member 310 according to vibration of the outer tub 2. Here, the first connection member 310 includes the piston 312 and the movable connector 316.

The second connection member 420 includes a cylinder 422 into which the piston 312 is inserted, and a friction member receptacle 425 which is formed at one side of the cylinder 422 such that the friction member 332 surrounding the piston 312 is accommodated in the friction member receptacle 425. The friction member 332 is moved along with the second connection member 420 according to vibration of the outer tub 2, thereby generating a predetermined magnitude of frictional force with the piston 312.

In addition, the second connection member 420 has an inlet portion 433 extending from the friction member receptacle 425, from which the piston 312 begins to be inserted, and a plurality of reinforcement ribs 434 arranged along an outer circumference of the inlet portion 433. With this configuration, the second connection member 420 may acquire sufficient rigidity to prevent damage or deformation of the inlet portion 433 even if the second connection member 420 is repeatedly moved relative to the piston 312.

The second connection member 420 may further include an outer tub connection portion 421, which may be coupled to the connection member coupling part 140 using the bushing 362, the elastic member 363, and the pin 361 in the same manner as the above described embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a casing;

an outer tub located within the casing;

an elongated supporter that is rotatably secured to the casing and suspends the outer tub from the casing;

a suspension, provided at a lower side of the outer tub and connected to the supporter, to attenuate vibration of the outer tub; and a damper to attenuate horizontal vibration of the outer tub by the introduction of friction according to a horizontal displacement of the outer tub, wherein the damper includes:

a first connector slidable along the supporter;

a second connector connected at one end to the first connector and at an other end to the outer tub, the second connector moving relative to the first connector according to the horizontal displacement of the outer tub; and at least one frictional material, movable along any one of the first connector or the second connector, providing a frictional force in response to movement according to vibration of the outer tub, wherein the first connector includes:

a slider that slides along the supporter and is rotatable about a central axis of the supporter; and a rotational joint that is rotatably coupled to the slider and rotatable in a direction perpendicular to a rotating direction of the slider.

2. The washing machine of claim 1, wherein the at least one frictional material is coupled to and surrounds either the first connector or the second connector.

3. The washing machine of claim 1, wherein the second connector is connected to an upper side of the outer tub at a position where the second connector does not pass over a reference symmetry axis of the outer tub.

4. The washing machine of claim 1, wherein either the slider or the rotational joint is provided with a coupling pin, and the other of the slider or the rotational joint is provided with a coupling hole for insertion of the coupling pin.

5. The washing machine of claim 4, wherein the coupling pin has a slope with which the other of the slider or the rotational joint contacts while the coupling pin is inserted into the coupling hole.

6. The washing machine of claim 1, wherein the at least one frictional material includes:

a first frictional material and a second frictional material coupled to the first connector so as to surround the first connector, wherein the second connector includes a receptacle in which the first frictional material and the second frictional material are accommodated, and wherein the receptacle includes a partition such that the first frictional material and the second frictional material are separately accommodated in the receptacle.

7. The washing machine of claim 6, wherein the second frictional material is moved within the receptacle according to vibration of the outer tub.

8. The washing machine of claim 6, wherein the second connector is integrally formed, and wherein the receptacle has an opening formed to allow passage of the first frictional material and the second frictional material upon assembly.

* * * * *